US005842873A

United States Patent [19]

Gonzales

[11] Patent Number: 5,842,873

[45] Date of Patent: Dec. 1, 1998

[54] DEVICE FOR CONNECTING A COAXIAL CABLE TO A PRINTED CIRCUIT CARD

[75] Inventor: Olivier Gonzales, St Nicolas de Macherin, France

[73] Assignee: Radiall, Rosy-Sous-Bois, France

[21] Appl. No.: 854,961

[22] Filed: May 13, 1997

[51] Int. Cl.[6] ..... H01R 9/09

[52] U.S. Cl. ..... 439/63; 439/329

[58] Field of Search ..... 439/63, 581, 351, 439/358, 329, 86

[56] References Cited

U.S. PATENT DOCUMENTS

| | | | |
|---|---|---|---|
| 4,645,288 | 2/1987 | Stursa | 439/63 |
| 5,120,258 | 6/1992 | Carlton | 439/581 |
| 5,173,058 | 12/1992 | Broeksteeg et al. | 439/329 |
| 5,293,177 | 3/1994 | Sakurai et al. | 439/581 |
| 5,482,475 | 1/1996 | Kawaguchi | 439/582 |

FOREIGN PATENT DOCUMENTS

| | | |
|---|---|---|
| 0692845 | 1/1996 | European Pat. Off. . |
| 9517024 | 6/1995 | WIPO . |

OTHER PUBLICATIONS

Motorola Technical Developments, vol. 13, Jul. 1991, Schaumburg, IL, pp. 131–132, XP000259257, Orlando Hernandez: "molded elastomeric connector".

*Primary Examiner*—Neil Abrams
*Assistant Examiner*—Jean F. Duverne
*Attorney, Agent, or Firm*—Schweitzer Cornman Gross & Bondell LLP

[57] ABSTRACT

The invention relates to a device for connecting a coaxial cable to a printed circuit card. The device comprises:

a body having a connection face and a housing suitable for receiving the end of a coaxial cable having conductors comprises a central core and an outer braid;

a fixing means suitable for holding said body with its connection face against a printed circuit card; and two axially compressible contact studs secured to the body and disposed in such a manner that one of them is electrically connected to the central core of the coaxial cable while the other one of them is electrically connected to the outer braid of the coaxial cable when the end of the coaxial cable is placed in said housing, each stud having an outer end outside the body projecting from the connection face thereof.

5 Claims, 3 Drawing Sheets

DEVICE FOR CONNECTING A COAXIAL CABLE TO A PRINTED CIRCUIT CARD

The present invention relates to a device for connecting a coaxial cable to a printed circuit card.

BACKGROUND OF THE INVENTION

Devices are already known that enable a coaxial cable to be connected to a printed circuit card, which devices are constituted by two connector elements, a male element and a female element, one being mounted at the end of the coaxial cable and the other being fixed to the printed circuit card by soldering or as a force-fit in holes provided for this purpose in the card.

An electrical connection is then made between the coaxial cable and the card by coupling together the two connector elements.

Those known devices suffer from the drawback of being relatively expensive to implement since they require numerous high precision parts to be manufactured and assembled.

Also, a large amount of handling is required to install such devices, firstly to the end of the coaxial cable, and secondly on the printed circuit card.

OBJECTS AND SUMMARY OF THE INVENTION

The present invention seeks to solve those drawbacks by providing a device for connecting a coaxial cable to a printed circuit card, which device has a smaller number of parts, and which parts are also easy to manufacture and assemble.

The present invention provides a device for connecting a coaxial cable to a printed circuit card, the device comprising:

- a body having a connection face and a housing suitable or receiving the end of a coaxial cable having conductors comprising a central core and an outer braid;
- a fixing means suitable for holding said body with its connection face against a printed circuit card; and
- two axially compressible contact studs secured to the body and disposed in such a manner that one of them is electrically connected to the central core of the coaxial cable while the other one of them is electrically connected to the outer braid of the coaxial cable when the end of the coaxial cable is placed in said housing, each stud having an outer end outside the body projecting from its connection face.

It will be understood that because of the fixing means, the two contact studs press against the printed circuit card when the connection face of the body is applied thereto.

It thus suffices to provide tracks on the printed circuit card situated to face the contact studs, with the outer ends of said contact studs coming to press against the tracks when the body is applied against the printed circuit card.

In this way, an electrical connection is provided without using solder between the tracks of the printed circuit card and the coaxial cable.

In a preferred embodiment of the invention, the body is made of two complementary portions each having a half-housing for the end of the coaxial cable, the two portions being suitable for closing on said end of the coaxial cable to hold onto said end.

In a particular embodiment, each contact stud includes, opposite from its outer end projecting from the connection face, an inner end inside the body projecting into the housing, each inner end being organized so that the respective corresponding conductor of the coaxial cable comes into contact with the stud when the coaxial cable is put into place with its stripped end inside the housing of the body.

Advantageously, the contact studs are made by compacting metal wires of very small diameter, e.g. molybdenum wires having a diameter of 0.01 mm.

In a preferred embodiment of the invention, the fixing means is constituted by a base suitable for receiving the body and for snap-fastening to hold the connection face against the printed circuit card.

The base is advantageously provided with pegs suitable for penetrating by force in holes made for that purpose in the printed circuit card.

BRIEF DESCRIPTION OF THE DRAWINGS

To make the invention easier to understand, there follows a description of an embodiment given by way of non-limiting example, and made with reference to the accompanying drawings, in which.

MORE DETAILED DESCRIPTION

Figure 1:
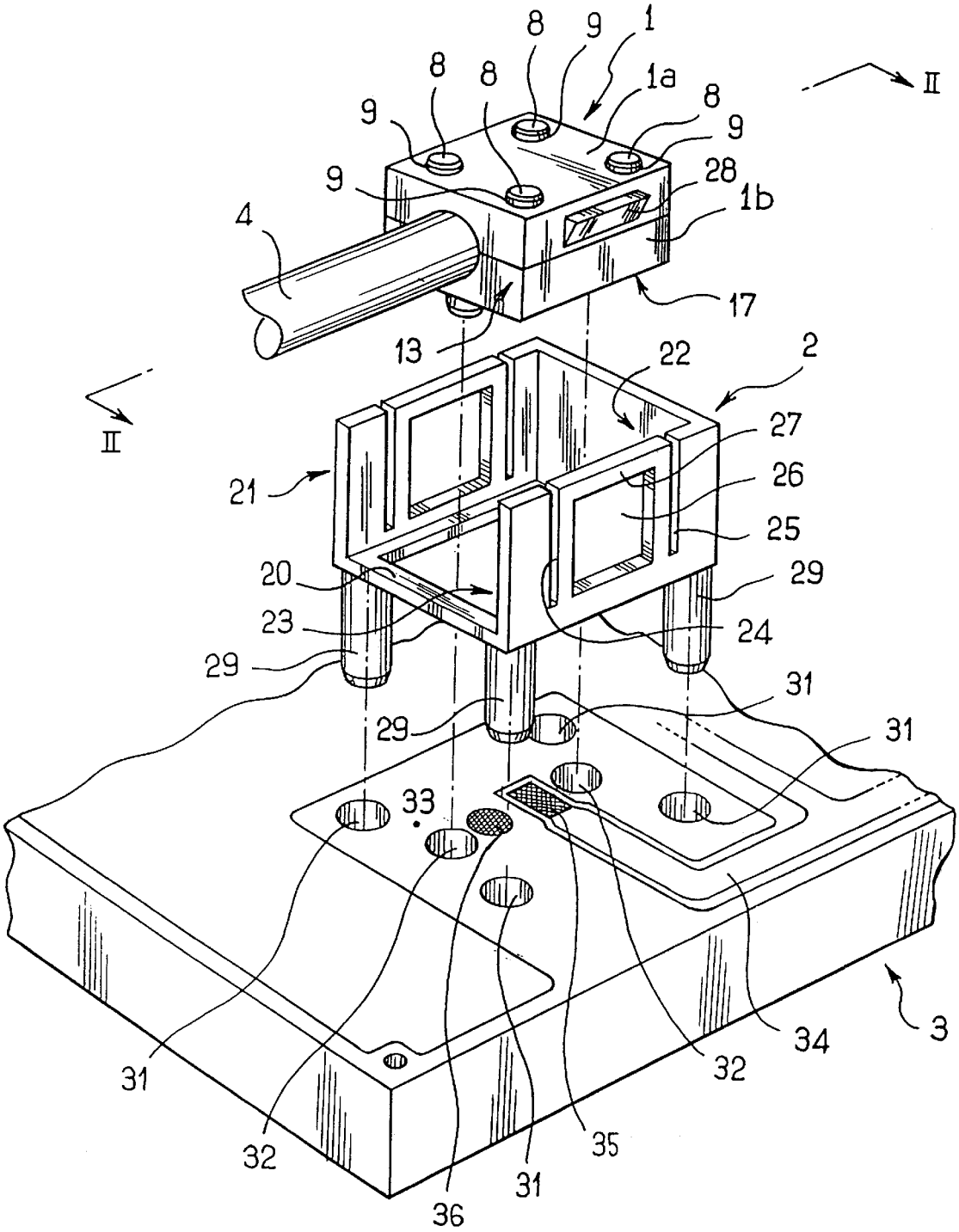
FIG. 1 is a perspective view of a device constituting an embodiment of the invention.

The device shown in the drawings comprises a body 1 that is generally in the form of a rectangular parallelepiped, and a base 2 constituting, in the meaning of the invention, a fixing means for fixing the body on a printed circuit card 3.

The body 1 is mounted at the end of a coaxial cable 4 which comprises an outer insulating sheath 5, and conductors comprising a metal braid 6 for shielding purposes and a conductive central core 7.

The body 1 is divided into two portions, a top portion 1*a* and a bottom portion 2*b* that are capable of being fixed together by means of pegs 8 projecting from the face of the bottom portion 1*b* that is situated facing the top portion 1*a*, and by means of corresponding through orifices 9 provided in the top portion 1*a*.

A housing is provided inside the body 1 to receive the coaxial cable 4.

This housing comprises two half-housings each provided in a respective one of the two portions 1*a* and 1*b* of the body, such that the axis of the housing lies in the join plane between the two portions 1*a* and 1*b* of the body.

In the top portion 1*a*, the half-housing has three semicylindrical lengths of decreasing diameter: a length 10 of diameter substantially equal to that of the sheath 5; a length 11 of diameter substantially equal to that of the outer braid 6; and a length 12 of diameter substantially equal to that of the central core 7.

The largest diameter length 10 opens out to one of the side faces 13 of the body 1, a tooth 14 formed by a portion of a smaller diameter collar extending over about 90° is provided in the opening of said length 10 to grip the sheath 5 when the two portions 1*a* and 1*b* of the body are assembled together, thereby holding the coaxial cable 4 in its housing.

The half-housing of the bottom portion 1*b* has lengths 10 and 11 identical to those of the top portion 1*a*.

In contrast, facing the length 12, the bottom portion 1*b* has a rectangular cavity 12'.

The bottom portion 1*b* also includes two through passages 15 and 16 which extend, for the passage 15, between the length 11 and the bottom face 17 of the portion 1*b*, which bottom face 17 constitutes, in the meaning of the invention, the connection face of the body 1, and for the passage 16 between the rectangular cavity 12' and said connection face 17.

Contact studs 18 and 19 made of compacted molybdenum wires and consequently presenting a degree of axial resilience, are received in the passages 15 and 16 with their ends projecting from both ends of said passages.

Figure 4:
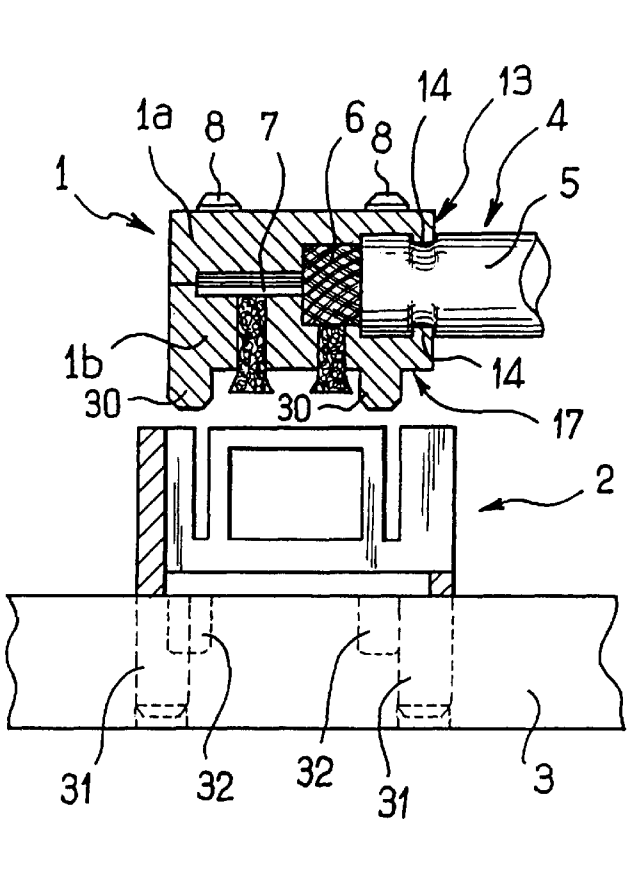
FIG. 4 is a view analogous to FIG. 2, after the base has been put into place on the printed circuit card.

As can be seen in FIG. 4, when the portions 1*a* and 1*b* of the body are joined together, the top ends of the contact studs 18 and 19, i.e. the ends inside the body in the meaning of the invention, are compressed and come into contact respectively with the outer braid 6 and with the central core 7 of the coaxial cable.

The base 2 which is made of plastics material has an outside shape that is in the form of a rectangular parallelepiped that is open in its face corresponding to the face 13 of the body 1, and that is also open in its top and bottom faces that are parallel to the printed circuit card 3.

It thus comprises a bottom frame 20 and three side walls 21, 22, and 23.

The side face 22 remote from the open face of the base 2 is solid, while each of the side faces 21 and 23 includes two slots 24 and 25 extending from its top edge to the vicinity of the bottom frame 20, and a window 26 formed between the slots 24 and 25 and extending from the vicinity of its top edge to the vicinity of the bottom frame 20.

The slots 24 and 25 and the window 26 thus define a kind of loop 27 constituting an upsidedown U-shape which is connected to the bottom frame 20 via the ends of its branches, and which, given the small thickness of its branches, presents sufficient resilience to enable the top portion 27 to be displaced sideways.

As can be seen in the drawings, the walls 21 and 23 are identical, and each of them is symmetrical about a vertical axis (relative to the drawing) passing through the middle thereof.

Figure 3:
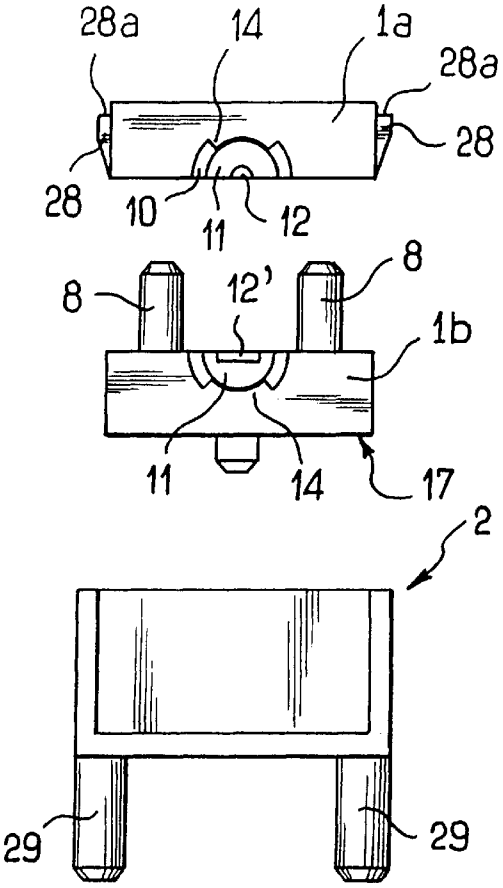
FIG. 3 is a view showing the righthand side of FIG. 2.
Figure 2:
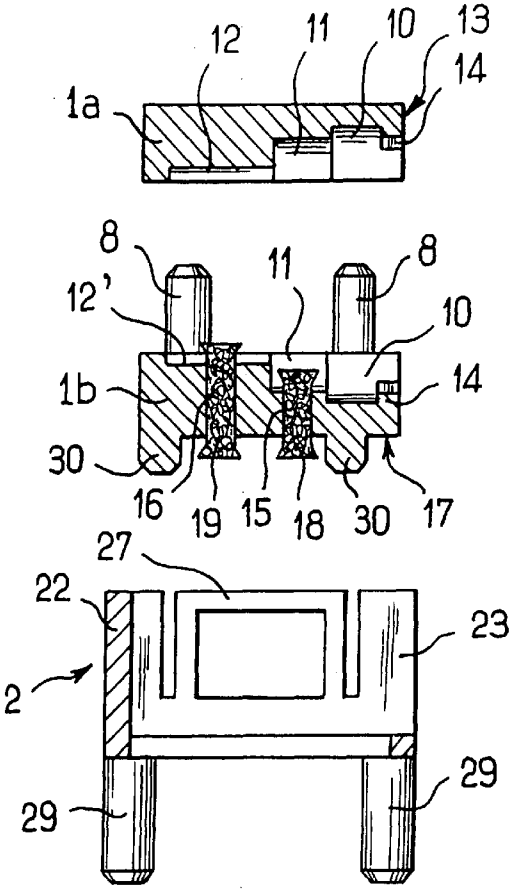
FIG. 2 is an exploded view in section on II—II showing the device of FIG. 1.

As can be seen in FIG. 3, the top portion 1*a* of the body 1 has side latches 28 which extend parallel to the axis of the coaxial cable 4 over a length corresponding to the width of the windows 26 in the base 2.

The latches 28 are of substantially triangular section enabling them to snap into the loops 27 by urging them outwards when the body 1 is being pushed into the base 2 in a direction perpendicular to the printed circuit card 3, and towards the card.

The position of the latches 28 up the sides of the body 1 is determined so that their top edges 28*a* are situated in the immediate vicinity of the horizontal branches of the loops 27 when the body is put into place in the base. Said body is thus snap-fastened in said base.

The base has a peg 29 in each of the four corners of its bottom face and the body has two pegs 30 projecting from its connection face 17 on the same alignment as the passages 15 and 16, and at opposite ends of that alignment.

The pegs 30 serve to protect the ends of the contact studs 18 and 19 while the body is not in place in the base.

To receive the base and the body, four through passages 31 are made in the printed circuit card 3 in correspondence with the pegs 29, and two orifices 32 are made in correspondence with the pegs 30.

Nearly all of the surface of the printed circuit card 3 facing the base 2 is coated in metallization 33 forming a ground plate.

A conductive track 34 penetrates into the metallization 33 as far as a pad 35 situated facing the contact stud 19.

Figure 5:
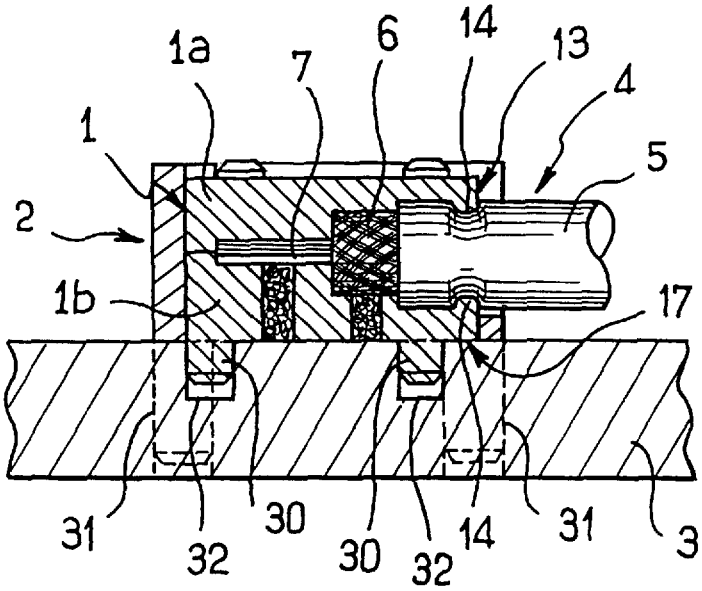
FIG. 5 is a view analogous to FIG. 4, after the body has been put into place in the base.

When the base is put into place on the printed circuit card 3 and the body 1 is snapped into the base, as shown in FIG. 5, the contact stud 19 comes into contact with the conductive track 34, thus electrically connecting the central core 7 of the coaxial cable 4 to said conductive track 34, while the outer braid 6 is connected to ground by the contact stud 18 which bears against the ground plate 33 via a pad 36.

The coaxial cable 4 is thus connected to the printed circuit card 3 without any solder and using a small number of parts, each part itself being cheap to make.

Naturally, the embodiment described above is not limiting in any way and may be modified in any desirable manner without thereby going beyond the ambit of the invention.

I claim:

1. A device for connecting a coaxial cable to a printed circuit card, the device comprising:

a body having a connection face and a housing suitable for receiving the end of a coaxial cable having conductors comprising a central core and an outer braid;

a fixing means suitable for holding said body with its connection face against a printed circuit card; and a two axially compressible contact studs secured to the body and disposed in such a manner that one of them is electrically connected to the central core of the coaxial cable while the other one of them is electrically connected to the outer braid of the coaxial cable when the end of the coaxial cable is placed in said housing, each stud having an outer end outside the body projecting from its connection face.

2. A device according to claim 1, wherein each contact stud includes, opposite from its outer end projecting from the connection face, an inner end inside the body projecting into the housing, each inner end being organized so that the respective corresponding conductor of the coaxial cable comes into contact with the stud when the coaxial cable is put into place with its stripped end inside the housing of the body.

3. A device according to claim 1, wherein the body is made of two complementary portions each having a half-housing for the end of the coaxial cable, the two portions being suitable for closing on said end of the coaxial cable to hold onto said end.

4. A device according to claim 1, wherein the contact studs are made by compacting metal wires of very small diameter, e.g. molybdenum wires having a diameter of 0.01 mm.

5. A device according to claim 1, wherein the fixing means is constituted by a base suitable for receiving the body and for snap-fastening to hold the connection face against the printed circuit card.

* * * * *